US011672369B2

(12) United States Patent
Bolles

(10) Patent No.: US 11,672,369 B2
(45) Date of Patent: Jun. 13, 2023

(54) THEFT-RESISTANT DEPOSIT BOX

(71) Applicant: David J. Bolles, Sammamish, WA (US)

(72) Inventor: David J. Bolles, Sammamish, WA (US)

( * ) Notice: Subject to any disclaimer, the term of this patent is extended or adjusted under 35 U.S.C. 154(b) by 0 days.

(21) Appl. No.: 17/486,540

(22) Filed: Sep. 27, 2021

(65) Prior Publication Data

US 2022/0117428 A1 Apr. 21, 2022

Related U.S. Application Data

(63) Continuation of application No. 16/432,863, filed on Jun. 5, 2019, now Pat. No. 11,129,487, which is a continuation-in-part of application No. 16/174,176, filed on Oct. 29, 2018, now Pat. No. 10,709,275, which is a continuation of application No. 15/662,195, filed on Jul. 27, 2017, now Pat. No. 10,111,547, which is a continuation of application No. 14/693,823, filed on Apr. 22, 2015, now Pat. No. 9,717,359.

(60) Provisional application No. 61/982,864, filed on Apr. 22, 2014.

(51) Int. Cl.

| | |
|---|---|
| ***A47G 29/124*** | (2006.01) |
| ***A47G 29/22*** | (2006.01) |
| ***A47G 29/10*** | (2006.01) |
| ***A47G 29/30*** | (2006.01) |

(52) U.S. Cl.

CPC ..... *A47G 29/124* (2013.01); *A47G 29/10* (2013.01); *A47G 29/1251* (2017.08); *A47G 29/22* (2013.01); *A47G 29/30* (2013.01)

(58) Field of Classification Search

CPC .. A47G 29/124; A47G 29/22; A47G 29/1209; A47G 29/1248; A47G 29/1251; A47G 29/12095; A47G 2029/1257; A47G 29/10; A47G 29/30

USPC ..... 232/17, 45, 47, 51

See application file for complete search history.

(56) References Cited

U.S. PATENT DOCUMENTS

| | | | | |
|---|---|---|---|---|
| 3,880,344 | A | 4/1975 | Earle | |
| 4,326,761 | A | 4/1982 | Schwartz | |
| 4,844,332 | A | 7/1989 | Long | |
| 4,848,650 | A | 7/1989 | Roberts, II | |
| 4,905,891 | A * | 3/1990 | Wildish | A47G 29/12095 232/17 |
| 5,000,378 | A * | 3/1991 | Dorr | A47G 29/12095 232/39 |
| 5,137,212 | A | 8/1992 | Fiterman et al. | |
| D333,545 | S * | 2/1993 | Rentz | D99/29 |
| 5,207,377 | A | 5/1993 | Brecht | |
| 5,564,624 | A | 10/1996 | Davis, Jr. | |
| 6,422,671 | B1 * | 7/2002 | Lodge | A47G 29/10 312/326 |

(Continued)

*Primary Examiner* — William L Miller

(74) *Attorney, Agent, or Firm* — Krista A. Wittman

(57) ABSTRACT

A wall mount deposit box is provided. A housing includes a front side and a back side. A rotatable content deposit includes a content delivery door and an inner panel affixed on a proximate end at an angle to a bottom of the content delivery door, and is pivotably attached to the front side of the housing. A content slot is formed as an opening within a front surface of the housing when the rotatable content deposit is in a fully open position allowing content to be deposited through the opening over each of the inner panel and the safety arm. A content retrieval door is located below the rotatable content deposit and is pivotably attached to the front side of the housing.

20 Claims, 13 Drawing Sheets

(56) References Cited

U.S. PATENT DOCUMENTS

| | | | | |
|---|---|---|---|---|
| 6,719,195 | B2 | 4/2004 | Farentinos | |
| 6,976,620 | B2 | 12/2005 | Swider | |
| 7,175,071 | B1 | 2/2007 | Slagle et al. | |
| 7,252,220 | B1 * | 8/2007 | Shreve | A47G 29/124 232/29 |
| 7,320,427 | B2 | 1/2008 | Prestwich | |
| 7,686,207 | B1 | 3/2010 | Jeffs | |
| 8,573,473 | B1 | 11/2013 | Farentinos et al. | |
| 8,960,530 | B2 | 2/2015 | Silke | |
| 9,004,346 | B2 | 4/2015 | Farentinos et al. | |
| 10,743,696 | B2 * | 8/2020 | Yang | G06Q 10/0836 |
| 11,253,094 | B1 * | 2/2022 | Deck | A47G 29/30 |
| 2003/0019921 | A1 * | 1/2003 | Cox | A47G 29/16 232/45 |
| 2005/0006450 | A1 | 1/2005 | Fitzgibbons et al. | |
| 2010/0006636 | A1 | 1/2010 | Frankenberg et al. | |
| 2016/0166100 | A1 | 6/2016 | Billue | |
| 2017/0127868 | A1 | 5/2017 | Adewuyi | |
| 2017/0295980 | A1 | 10/2017 | Willcox | |
| 2018/0352987 | A1 | 12/2018 | Kutas et al. | |
| 2019/0282013 | A1 | 9/2019 | Bolles | |
| 2020/0085222 | A1 | 3/2020 | Kutas et al. | |
| 2022/0022680 | A1 * | 1/2022 | Farentinos | A47G 29/22 |
| 2023/0014387 | A1 * | 1/2023 | Miller | A47G 29/1203 |

* cited by examiner

THEFT-RESISTANT DEPOSIT BOX

CROSS-REFERENCE TO RELATED APPLICATIONS

This non-provisional patent application is a continuation of U.S. Pat. No. 11,129,487, issued Sep. 28, 2021, which is a continuation-in-part of U.S. Pat. No. 10,709,275, issued Jul. 14, 2020, which is a continuation of U.S. Pat. No. 10,111,547, issued Oct. 30, 2018, which is a continuation of U.S. Pat. No. 9,717,359, issued Aug. 1, 2017, which claims priority to U.S. Provisional Patent Application, Ser. No. 61/982,864, filed Apr. 22, 2014, the priority dates of which are claimed and the disclosures of which are incorporated by reference.

FIELD

The invention relates in general to protective boxes and, specifically, to a theft-resistant deposit box.

BACKGROUND

Identity theft is currently the fastest growing crime in the U.S. Thieves frequently steal mail as an easy and relatively low risk way of acquiring personal information that may be assembled into viable and marketable information for identity theft. Many consumers purchase locking mailboxes in an attempt to thwart mail theft. Locking wall mount mailboxes are a popular product because they allow for space efficient mounting on walls that would not accommodate more traditional curbside locking mailbox designs. However, including a locking mechanism on wall mount mailboxes provides only a partial solution. Many of these products are inferior and are easily violated. Most locking wall mount mailboxes feature an incoming mail slot of various sizes to allow for receipt of mail. Bins are not typically employed in shallower style wall mount locking mailboxes since the bottom member of the bin door impedes mail delivery when the door is closed. The traditionally employed slot doors suffer from a design flaw that allows thieves to simply insert their arm or a fishing tool through the incoming mail slot and retrieve the contents, thereby bypassing the locked door. Access to the interior of the mailbox is formed when the un-lockable incoming mail door is opened. Wall mount mailboxes with incoming mail slots small enough to prevent fishing cannot accept mail bundles or small parcels. Thus there exists a tradeoff between ease of use and mail security in locking wall mount mailboxes. Accordingly, there is a need for a locking wall mount mailbox that incorporates theft-resistant design to deter fishing when the incoming mail door is opened, but still allows for receipt of mail bundles and small parcels.

SUMMARY

A theft-resistant wall mount locking mailbox includes a housing that has top and bottom plates, a rear wall, and one or more doors, which are affixed to a front surface of the housing, which enclose a space in which mail is received and stored. The doors can include a lockable mail retrieval door and a non-lockable mail delivery door, which are each pivotably attached to the front of the housing. The non-lockable mail delivery door can include a mail receiver bin door configured to receive mail bundles and small parcels. Specifically, the mail delivery door includes a top member affixed at an angle to a bottom member. The top member includes a substantially flat surface that faces the front of the mailbox in a closed position and the bottom member includes an angled surface located inside the housing that extends toward the front surface on the inside of the mailbox in an open position. The bottom member of the mail delivery door includes a downward-angled security arm to prevent would-be thieves from reaching their hand into the mailbox without impeding delivery of the mail into the mailbox.

Together, the top and bottom members move to open and close the mail delivery door. When the mail delivery door is closed, the mail bundles and small parcels fall to the bottom of the mailbox, where they can be retrieved via the lockable mail retrieval door. A further embodiment provides a wall mount mailbox. A housing includes a front side and a back side. A rotatable mail deposit includes a mail delivery door and an inner panel affixed on a proximate end at an angle to a bottom of the mail delivery door, and is pivotably attached to the front side of the housing. A mail slot is formed as an opening within a front surface of the housing when the rotatable mail deposit is in a fully open position allowing mail to be deposited through the opening over each of the inner panel and the safety arm. A mail retrieval door is located below the rotatable mail deposit and is pivotably attached to the front side of the housing.

A still further embodiment provides a wall mount deposit box. A housing includes a front side and a back side. A rotatable content deposit includes a content delivery door and an inner panel affixed on a proximate end at an angle to a bottom of the content delivery door, and is pivotably attached to the front side of the housing. A content slot is formed as an opening within a front surface of the housing when the rotatable content deposit is in a fully open position allowing content to be deposited through the opening over each of the inner panel and the safety arm. A content retrieval door is located below the rotatable content deposit and is pivotably attached to the front side of the housing.

Still other embodiments of the invention will become readily apparent to those skilled in the art from the following detailed description, wherein are described embodiments of the invention by way of illustrating the best mode contemplated for carrying out the invention. As will be realized, the invention is capable of other and different embodiments and its several details are capable of modifications in various obvious respects, all without departing from the spirit and the scope of the invention. Accordingly, the drawings and detailed description are to be regarded as illustrative in nature and not as restrictive.

DETAILED DESCRIPTION

Figure 1:
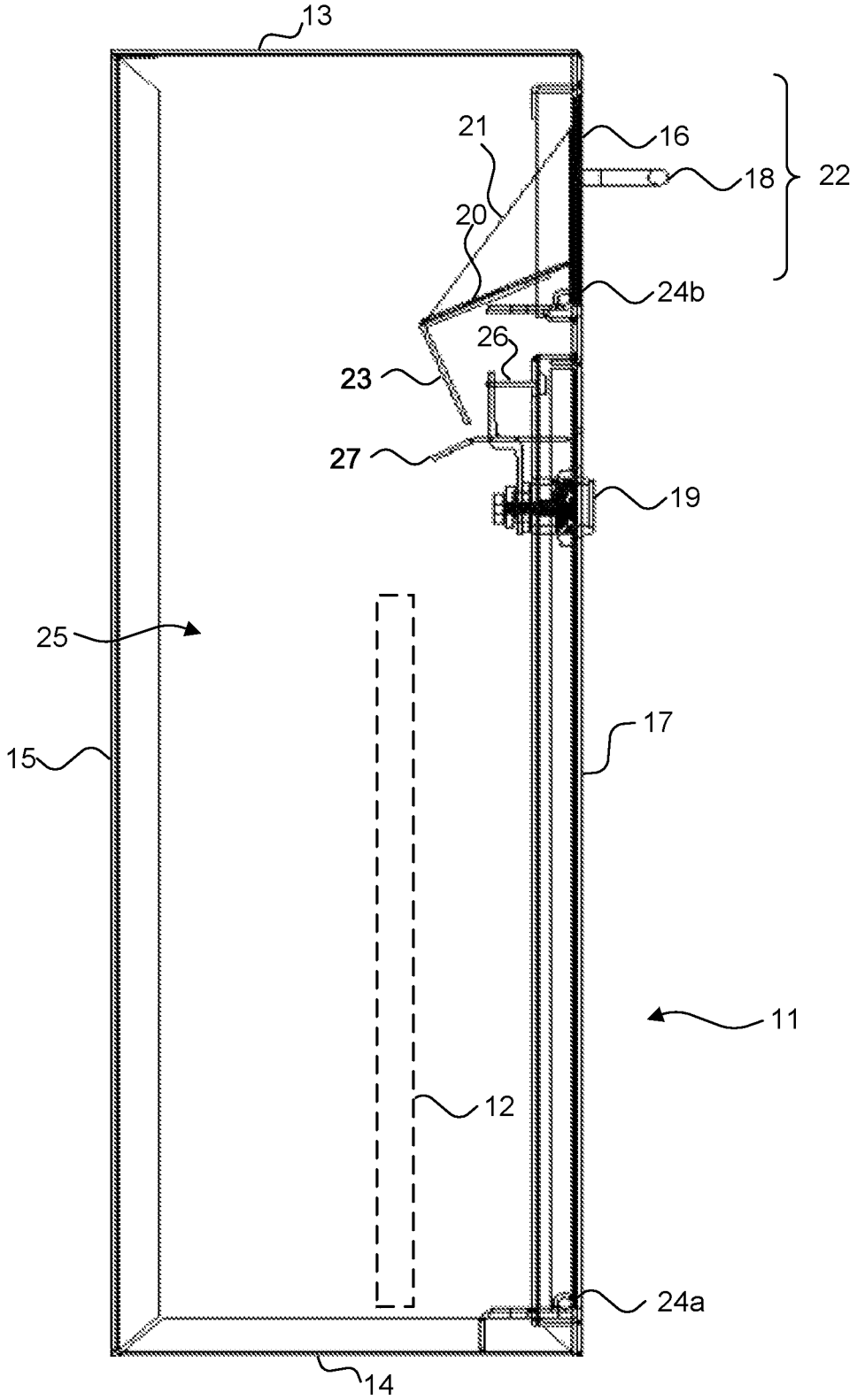
FIG. 1 is a side view showing a theft-resistant wall mount mailbox for mail bundles and small parcels, in accordance with one embodiment.

A theft-resistant wall mount locking mailbox can prevent would-be thieves from accessing personal mail. FIG. 1 is a side view showing, by way of example, a theft-resistant wall mount mailbox 11 for mail 12 bundles and small parcels. The mailbox includes a housing that includes top 13, bottom 14 and back 15 sides, as well as a front side having a mail delivery door 16 and a mail retrieval door 17. Together, the sides form an enclosure for storing mail and small parcels. In one embodiment, the housing can be shaped as a rectangle with the front and back sides longer than the top and bottom sides. The shape and size of the mailbox housing and mail delivery door can be varied to allow mail bundles and parcels of different sizes, while still having a size small enough to be mounted on a wall.

The mailbox 11 can be securely affixed to a wall surface (not shown) of wood, stucco, cement, brick, or other materials using hardware. Specifically, the rear or back side 15 wall of the mailbox can include a variable number of pre-drilled holes (not shown) that allow for the mailbox 11 to be attached to a wall surface using wood screws, masonry screws, or other appropriate hardware. The number of holes and screws can vary depending on the application.

Once affixed to a wall surface, mail can be delivered through the mail delivery door 16 and retrieved through the mail retrieval door 17. Generally, the mail delivery door 16 can be non-lockable to allow postal carriers to deposit mail within the mail box, while the mail retrieval door 17 can be lockable to prevent would-be thieves from accessing the mail once inside the mailbox. Further, each of the doors can include a handle 18 to assist with opening of the respective door.

The lockable mail retrieval door includes a flat surface that lies along a front surface of the mailbox in a closed position and an anti-pry lock 19 to prevent access to delivered mail or articles, except by those individuals having a key to operate a locking mechanism. The mail retrieval door can be pivotably mounted on the front side of the mailbox 11 at a bottom edge via a fulcrum 24*a* to allow the doors to rotate in open and closed positions. Fulcrum fixation of the parcel receipt door 16 can include a hinge style attachment, a ball and joint device, rods, or a gear mechanism. Other methods and components for affixing the parcel receipt door to the fulcrum can be used.

When opened, the flat surface of the door moves outward away from the front surface of the mailbox. Prior to being opened, a user or owner of the mailbox must insert a proper key into the anti-pry lock 19 to unlock the door 17. The anti-pry lock 19 is further described below with reference to FIGS. 5-8. The anti-pry lock 19 utilizes a striker pin 26 and an anti-pry plate 27 to prevent a third party from forcefully pulling open the mail retrieval door 17 and accessing any mail within the mailbox. Other components and mechanisms for securing the lockable door to the mailbox can be used.

The mail deposit door 16 includes a flat surface that is positioned along a front surface of the mailbox when in a closed position and an inner panel 20, which is located within the interior 25 of the housing 11 and affixed at an angle to the mail delivery door 16 to receive and guide incoming mail and parcels into the mailbox 11. More specifically, a proximal edge of the inner panel 20 can be affixed to the bottom edge of the mail deposit door 16. The angle between the inner panel 20 and mail delivery door 16 can vary to accommodate different size envelopes and packages. In one embodiment, the angle is at least as great as a right angle. Together, the mail delivery door 16 and inner panel 20 rotate about a horizontal axis based on the opening and closing of the parcel receipt door 16. A sphere of rotation is defined by movement of a distal edge of the inner panel within the housing based on the horizontal axis.

Additionally, one or more side panels 21 can be interfixed between the mail delivery door 16 and inner panel 20 to assist in guiding the envelope or parcel into the mailbox 11. The side panels 21 can include a rod, bar, or flat surface. Other types of side panels are possible. Together, the parcel receipt door 16, inner panel 20, and side panels 21 form a rotatable mail deposit 22 that allows mail carriers and other individuals to deliver mail, envelopes, parcels, and other articles into the mailbox 11. The rotatable mail deposit 22 can be rotatably affixed to the front surface of the housing 11 via the parcel receipt door 16, as described above, inner panel 20, or side panels 21.

Specifically, the rotatable mail deposit 22 can be rotatably affixed to the housing by a fulcrum 24*b*, allowing for the mail delivery door 16 to open, receive mail and small parcels, and then close, causing the mail and small parcels to slide into a secure area at the bottom inside 25 of the mailbox 11, which is protected by the locked mail retrieval door 17. The fulcrum can be attached to the mail delivery door 16 or inner panel 20, or both. Fulcrum 24*b* fixation of the mail delivery door can include a hinge style attachment to a base of the mail delivery door 16, a ball and joint device, rods, or a gear mechanism. Other methods and components for affixing the fulcrum 24*b* can be used. The mail delivery door 16 is affixed by the fulcrum 24*b* in such a way that the mail delivery door can articulate through a range of motion about a horizontal axis, thus causing the mail delivery door to sweep through an open position to receive mail, all the way to a closed position where the mail delivery door can allow the mail to fall into the interior 25 of the mailbox for safe keeping.

In a further embodiment, the rotatable mail deposit 22 includes a safety arm 23 that is affixed at an angle to the inner panel 20 in a direction away from the mail delivery door 16. In one embodiment, the angle is less than 115 degrees. However, other angles are possible. At a minimum, the angle should be large enough to allow the safety arm to prevent a would-be thief from inserting his arm into the interior of the mailbox, but small enough to allow mail and parcels to pass to the bottom of the mailbox interior. The length of the security arm 23 is dependent on the angle between the inner panel 20 and the security arm 23. The security arm 23 should not extend past a midline of the mailbox 11. The midline can be determined by bisecting a center of the mailbox parallel to the front surface, as described further below with reference to FIG. 2.

Figure 2:
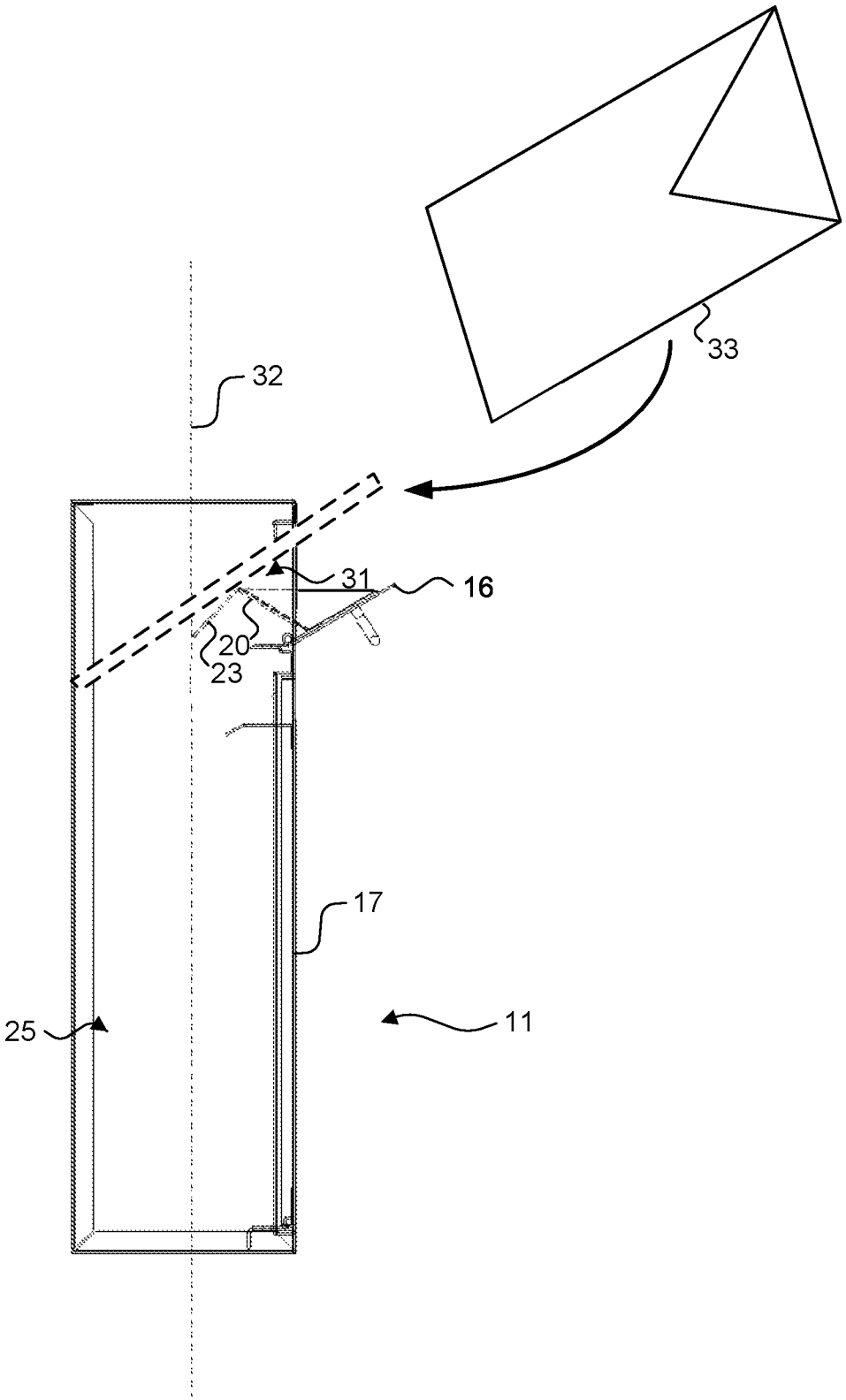
FIG. 2 is a side view showing the theft-resistant wall mount mailbox of FIG. 1 with a mail delivery door in an open position.

Mail or parcels are delivered via the rotatable mail deposit and retrieved through the mail delivery door. FIG. 2 is a side view showing the theft-resistant wall mount mailbox 11 of FIG. 1 with a mail delivery door 16 in an open position. Incoming mail is inserted through a slot 31 to receive mail, or by way of a mail opening formed by opening the non-lockable mail delivery door 16. The security arm 23, or angled bottom member, guides incoming mail 33 into the interior 25 bottom of the mailbox 11. When the rotatable mail deposit 16 is in a closed position, the security arm 23 extends in a downward fashion from the inner panel 20 towards the interior 25 bottom side of the mailbox 11. In one embodiment, the security arm 23 should not extend beyond a midline 32 of the mailbox. As described above, the midline 32 is determined by bisecting a center of the mailbox 11 parallel to the front surface. Extension of the security arm 23 past the midline 32 can impede receipt of the mail 33 into the mailbox 11. The security arm 23 can be made from metal, steel, plastic, wood, or other material.

As the mail delivery door 16 is opened, the security arm 23, or bottom member of the mail delivery door effectively limits the space created when the mail retrieval door is opened. In this way, the opening to the interior 25 of the mailbox 11 is restricted by the space occupied by the security arm 23 as the mail retrieval door moves from the open to the closed position, and at various positions in the range of motion of the mail delivery door. A mail thief would be restricted from putting a hand into the box when the mail retrieval door is open or semi-open.

Once the inbound mail 11 falls to the floor of the mailbox, the mail can be easily retrieved through the locked lower mail retrieval door 17 by individuals with an appropriate key. Unauthorized access to mail or articles that have been delivered is prevented by the lockable mail retrieval door 17. The lockable mail retrieval door 17 has a lock and latch which engages a lock cam with a striker, reinforced by the anti-pry plate, securing the lockable door until it is opened with a key. A locking mechanism suitable for use with the mailbox is described in commonly-owned U.S. Pat. No. 7,441,696, issued on Oct. 28, 2008, the disclosure of which is incorporated by reference and is further described below with reference to FIGS. 5-8.

Figure 3:
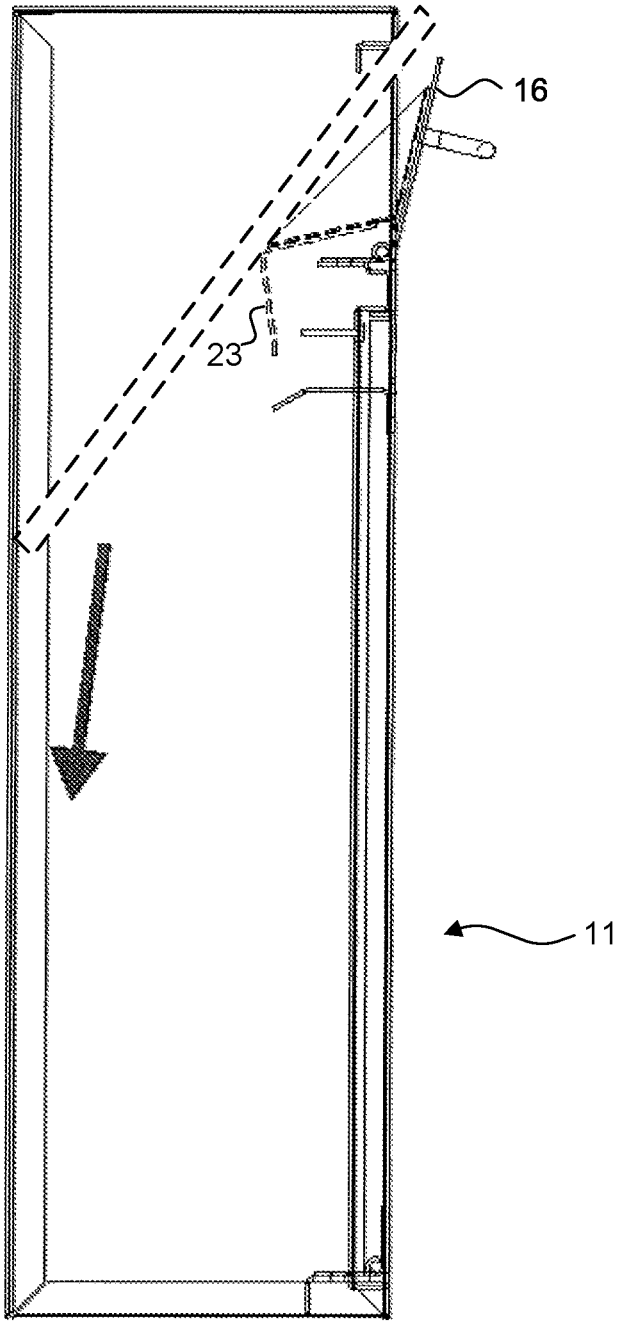
FIG. 3 is side view showing the theft-resistant wall mount mailbox of FIG. 1 with a mail delivery door in a semi-closed position.

FIG. 3 is side view showing the theft-resistant wall mount mailbox of FIG. 1 with a mail delivery door 16 in a semi-closed position. Closing the mail delivery door 16 causes the security arm 23, or bottom member of the mail delivery door to move out of the way and allow the mail bundle or parcel to freely slide into the secure area of the mailbox. As well, the closing of the mail delivery door closes, or reduces the size of the open slot formed when the mail delivery door 16 is open to prevent would be thieves from reaching into the interior of the mailbox 11. Further embodiments can include various slots or spaces so that standard thin envelope mailers and envelope style mail may be inserted without having to close the door. The slots and spaces should be small enough to prevent unauthorized access.

Figure 4:
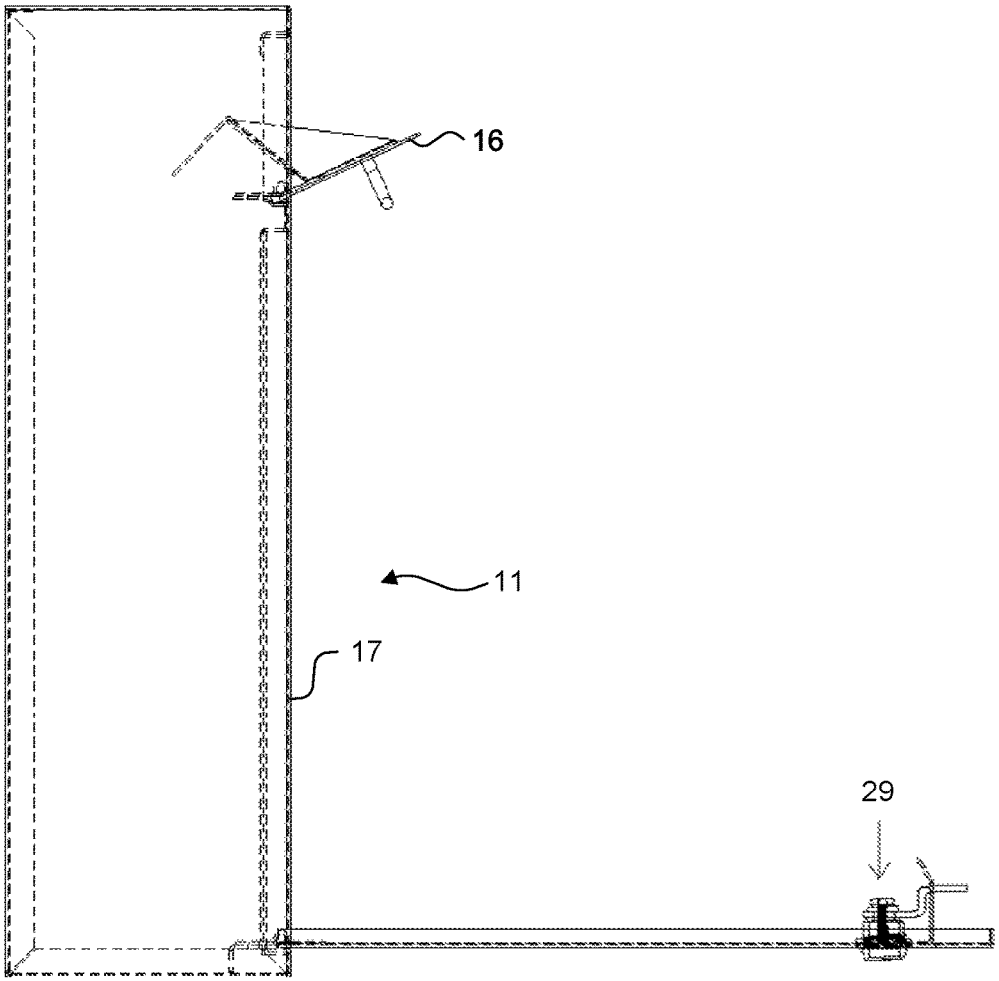
FIG. 4 is a side view showing the theft-resistant wall mount mailbox of FIG. 1 with a mail delivery door in an open position and a mail retrieval door in an open position.
Figure 5:
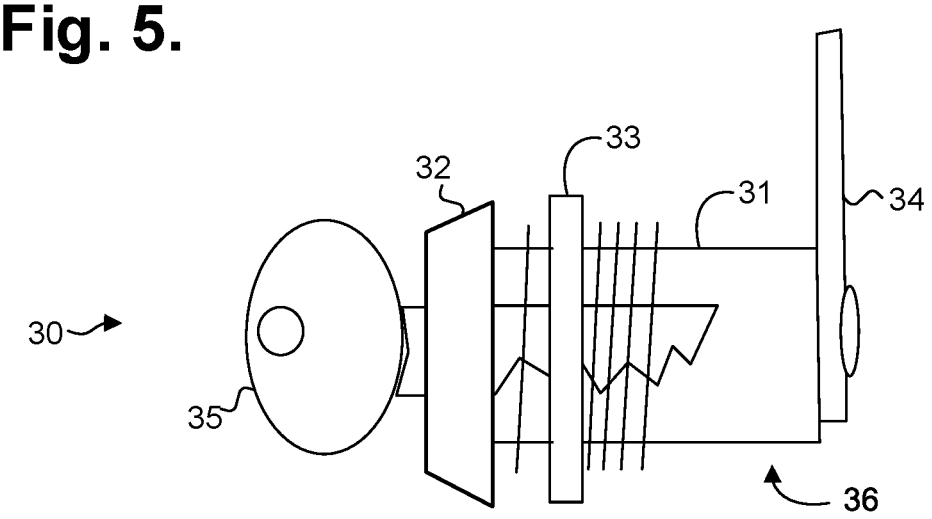
FIG. 5 is a side view showing, by way of example, a locking mechanism for a theft-resistant mailbox.

FIG. 4 is a side view showing the theft-resistant wall mount mailbox of FIG. 1 with a mail delivery door 16 in an open position and a mail retrieval door 17 in an open position. The mail retrieval door 17 can be opened upon unlocking of the anti-pry lock 29. FIG. 5 is a side elevational view showing a locking mechanism 30 for a theft-resistant mailbox, in accordance with one embodiment. The locking mechanism 30 can include an anti-pry lock having a locking tumbler 31 and matching key 35, which are installable in a mailbox door or similar enclosure, such as the mail retrieval door 17. Additionally, the locking mechanism 30 could be installed on a fixed surface against which a door opening abuts.

Figure 6:
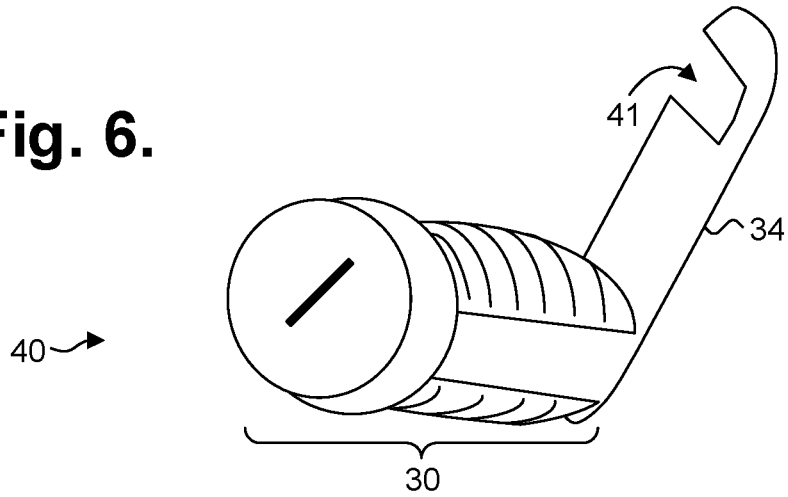
FIG. 6 is perspective view showing the locking mechanism of FIG. 5.

The locking mechanism 30 is installed by fitting the tumbler 31 through a fitted opening sized to receive the outside barrel of the tumbler 31 and sliding the tumbler 31 into the opening until the inside edge of a keyway facing 32 engages the outer edge of the mailbox door. The locking mechanism 30 is fastened into place by tightening a retaining bolt 33, or similar fastener, such as a retaining clip or fastener assembly. The tumbler 31 is rotatably coupled to an internal cam 34, which locks the mailbox door when the door is closed and the key 35 is turned. The internal cam 34 rotates freely in the same direction as the key 35, while the outside barrel of the tumbler 31 remains fixed in place on the mailbox door. FIG. 6 is perspective view showing the locking mechanism 30 of FIG. 5. The far edge of the internal cam 34 is formed into a cutout 41 that is open in the angle of rotation. The cutout 41 can be square or rectangular, as well as U- or C-shaped. Other shapes of cutouts are possible.

Figure 7:
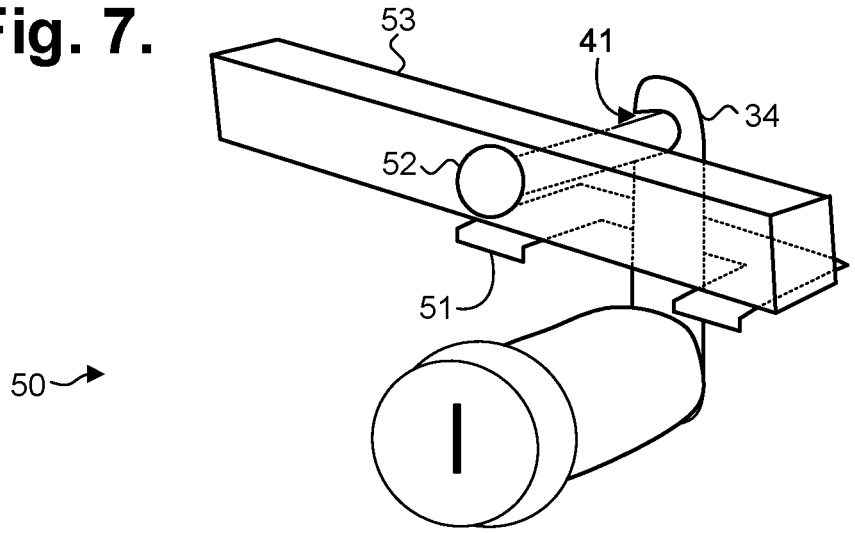
FIG. 7 is perspective view showing the locking mechanism of FIG. 5 as installed within a theft-resistant mailbox.

The locking mechanism 30 also includes components installed within the mailbox. FIG. 7 is perspective view showing the locking mechanism 30 of FIG. 5 as installed within a theft-resistant mailbox. A striker pin 52 is fixedly attached to a frame 53 within the interior of the mailbox. Alternatively, the striker pin 52 can be installed within the mailbox door within which the locking mechanism is installed. The cutout 41 of the internal cam 34 is sized to be received over the striker pin 52. When the key 35 is turned, the cutout 41 engages the internal cam 34 over the striker pin 52. In addition, an anti-pry plate 51 is fixedly attached to the inside surface of the mailbox door above the tumbler 31. The anti-pry plate 51 surrounds the internal cam when the locking mechanism is in the locked position.

Figure 8:
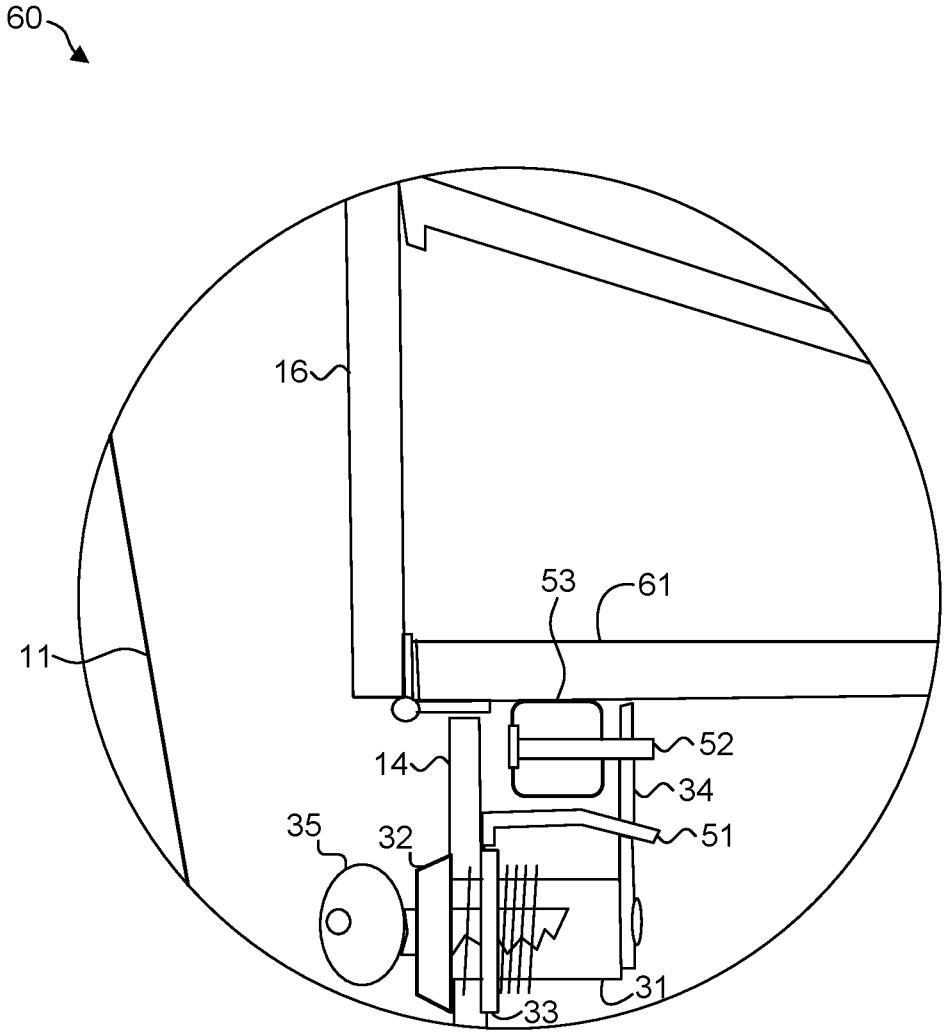
FIG. 8 is a cross-sectional view showing the locking mechanism of FIG. 5 as installed within a theft-resistant mailbox.

The internal cam 34, striker pin 52, and anti-pry plate 51 synergistically protect a mailbox door against compromise. FIG. 8 is a cross-sectional view 60 showing the locking mechanism 30 of FIG. 5 as installed within a theft-resistant mailbox 11. The frame 53 is fixably attached to a chassis 61 of the mailbox 11. Additionally, the striker pin 52 extends beyond the point of engagement to the internal cam 34. A prying force applied to the mailbox door 14 would be transferred onto the mailbox chassis 61 through the combination of the cutout 41, striker pin 52, and frame 53, as well as onto the mailbox door 14 through the anti-pry plate 51. As a result, a would-be theft would have to provide force significantly greater than required to overcome a conventional key-and-tumbler cam. In a further embodiment, a bin, or rotating mail deposit suitable for use with the mailbox is described in commonly-owned U.S. Pat. No. 7,946,472, the disclosure of which is incorporated by reference.

Figure 9:
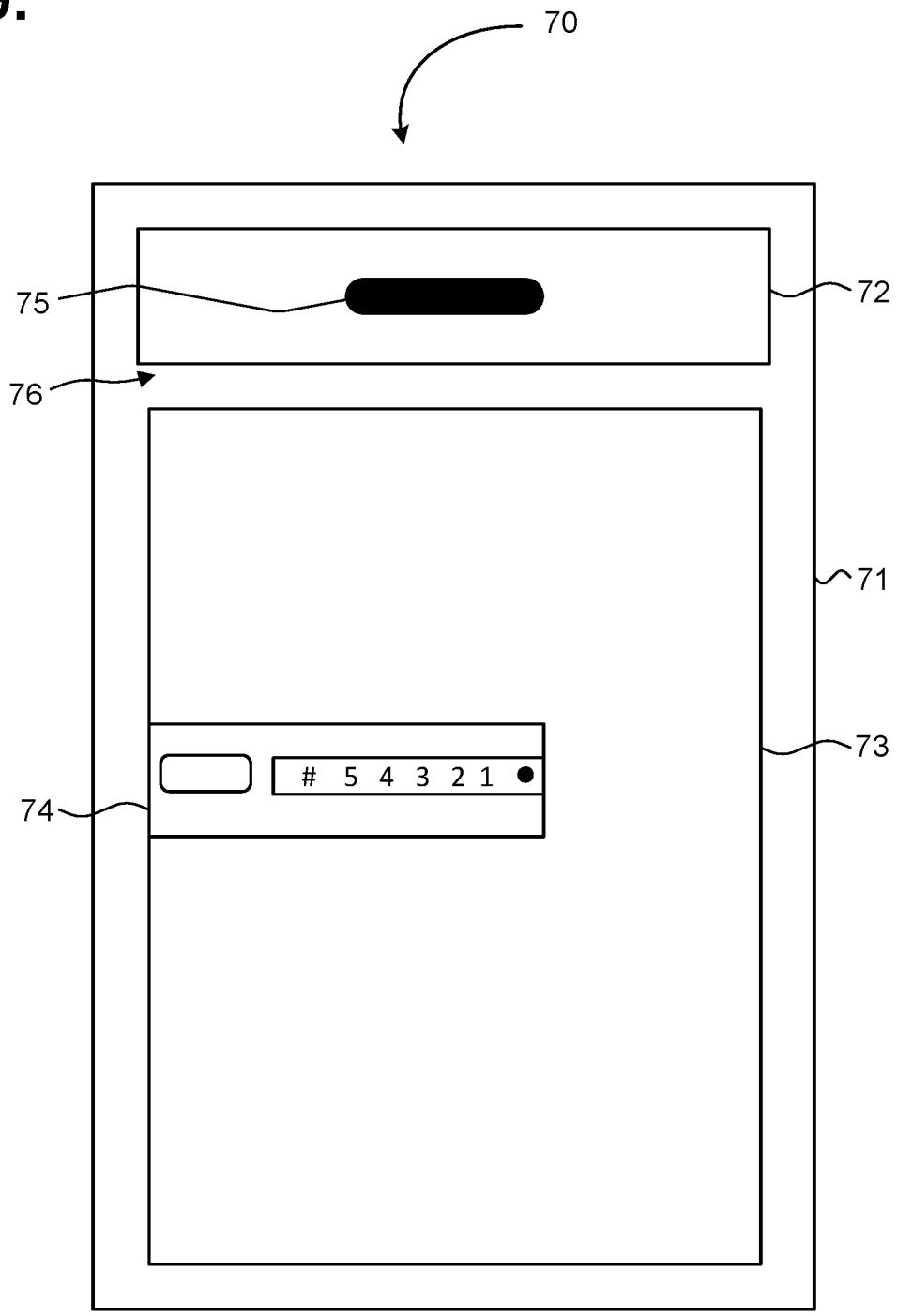
FIG. 9 is a front view showing, by way of example, a key box with a security lock.

In a further embodiment, an interior of the mailbox can be modified to generate a theft-resistant deposit box for keys, checks, money, or other types of goods. For example, an apartment rental office may install the theft-resistant drop box outside of the office for tenants to safely deposit rent checks or a rental car agency can utilize the deposit box for car renters to drop off keys for rental cars after hours. An interior of the mail box with the delivery and retrieval doors can be modified to collect deposited items and store such items. For example, key racks can line an interior of the box to hang keys, such as car keys or house keys. FIG. 9 is a front view showing, by way of example, a key box 70 with a security lock 74. The key box 70 includes a housing 71 with top, bottom, front and back sides (not shown), as described above in detail with respect to FIG. 1. In one embodiment, the key box 70 can be shaped as a rectangle and can be made from material, such as a metal, steel, plastic, wood, or other material. Other shapes and material are possible. A size of the key box 70 can be dependent on a number of keys to fit within an interior of the key box 70.

The key box 70 can be affixed to a wall or other substantially flat surface on the back side of the housing using hardware, such as nails, screws, or other adhesive mechanisms. Specifically, the rear or back side 15 wall of the mailbox can include a variable number of pre-drilled holes (not shown) that allow for the mailbox 11 to be attached to a wall surface using wood screws, masonry screws, or other appropriate hardware. The number of holes and screws can vary depending on the weight and size of the deposit box 70.

The front side of the key box 70 can include a key deposit door 72 with a handle 75 and a key receipt door 73, as described above in detail with respect to FIG. 1. Specifically, the front side of the housing 71 can have a substantially flat rectangular shape with two voids (not shown), one for the key deposit door 72 and the key receipt door 73. A middle portion 76 of the front side of the housing 71 can act as a support for particular components of the key box 70, as well as to separate the key deposit door from the key receipt door. For example, one or more attachment mechanisms can be affixed to an inner surface of the middle portion 76 of the front side of the housing to attach the key deposit door 72 to the housing. The attachment mechanism can include a hinge, a ball and joint device, rods, or a gear mechanism, as well as other type of attachments. The key deposit door 72 can be pivotably mounted on a bottom side along a front surface of the housing such that when the key deposit door is in a closed position, an outer surface of the key deposit door is positioned along substantially the same plane as outer surface of the front side of the housing.

One or more keys or sets of keys can be delivered to an interior of the key box 70 via the key deposit door 72 and the keys can be retrieved via the key receipt door 73. The key deposit door 72 can be non-lockable to allow users to deposit keys, such as upon returning a rental vehicle, while the key receipt door 73 can optionally include a locking mechanism 74 to prevent unauthorized access to the contents of the key box 70. The locking mechanism 74 can be electronic or mechanical. A mechanical locking mechanism can utilize a key to gain access to an interior of the housing, such as described above with respect to FIGS. 5-8. An electronic locking mechanism can provide access to the housing 71 interior using an access code, which can include numbers, letters, and symbols, as well as a combination of numbers, letters, and symbols.

Figure 10:
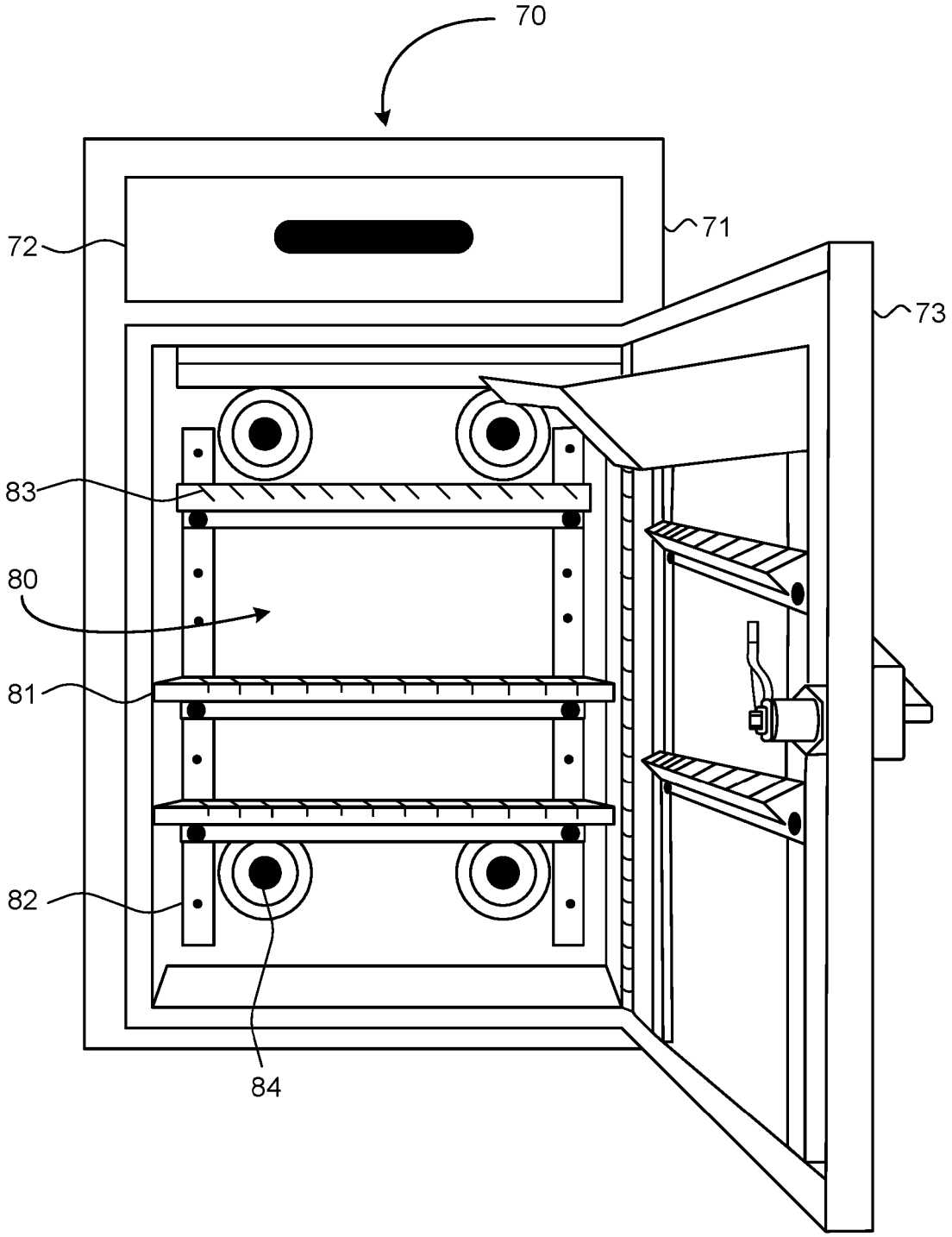
FIG. 10 is a front view of the key box of FIG. 9 with the key retrieval door in an open position.

Within an interior of the housing 71, a user can access the contents of the key box, such as keys. FIG. 10 is a front view of the key box 70 of FIG. 9 with the key retrieval door 73 in an open position. The key retrieval door 73 can be pivotably mounted to the housing along a top, bottom, right, or left side of the key retrieval door 73. Specifically, the key retrieval door 73 can be affixed along one side of the housing via a fulcrum to allow the door to rotate in open and closed positions. Fulcrum fixation of the key receipt door 73 can include a hinge style attachment, a ball and joint device, rods, or a gear mechanism. In one embodiment, the fulcrum can be located in an interior of the housing along the front side of the housing. In a further embodiment, the key receipt door 73 is directly attached to the front side of the housing via a hinge. The hinge can include a barrel hinge, piano hinge, butterfly hinge, flush hinge, or pivot hinge, as well as other types of hinges. Other methods and components for affixing the key receipt door to the fulcrum or the housing can be used.

An interior 80 of the housing 71 can include predrilled holes 84 for affixing the deposit box 70 to a surface and storage for deposited content, such as keys. When the deposit box is used for keys, one or more key racks 81 can be installed in an interior of the key box 70. Each key rack 81 can be affixed horizontally across an interior surface of the housing or to brackets 82 that are affixed to the interior surface of the housing. In one embodiment, the brackets 83 are positioned vertically on an interior surface of the back side of the key box 70. The key racks 81 or brackets 82 can be affixed to the housing of the key box 70 via attachment mechanisms, including staples, pins, rivets, glue, or soldering the racks or brackets directly to the housing. Other attachment mechanisms are possible. When brackets 82 are used, the key racks 81 can be removably affixed to the brackets via screws, plugs, pins, or pegs to change positions of the key racks or to add or remove key racks.

Figure 11:
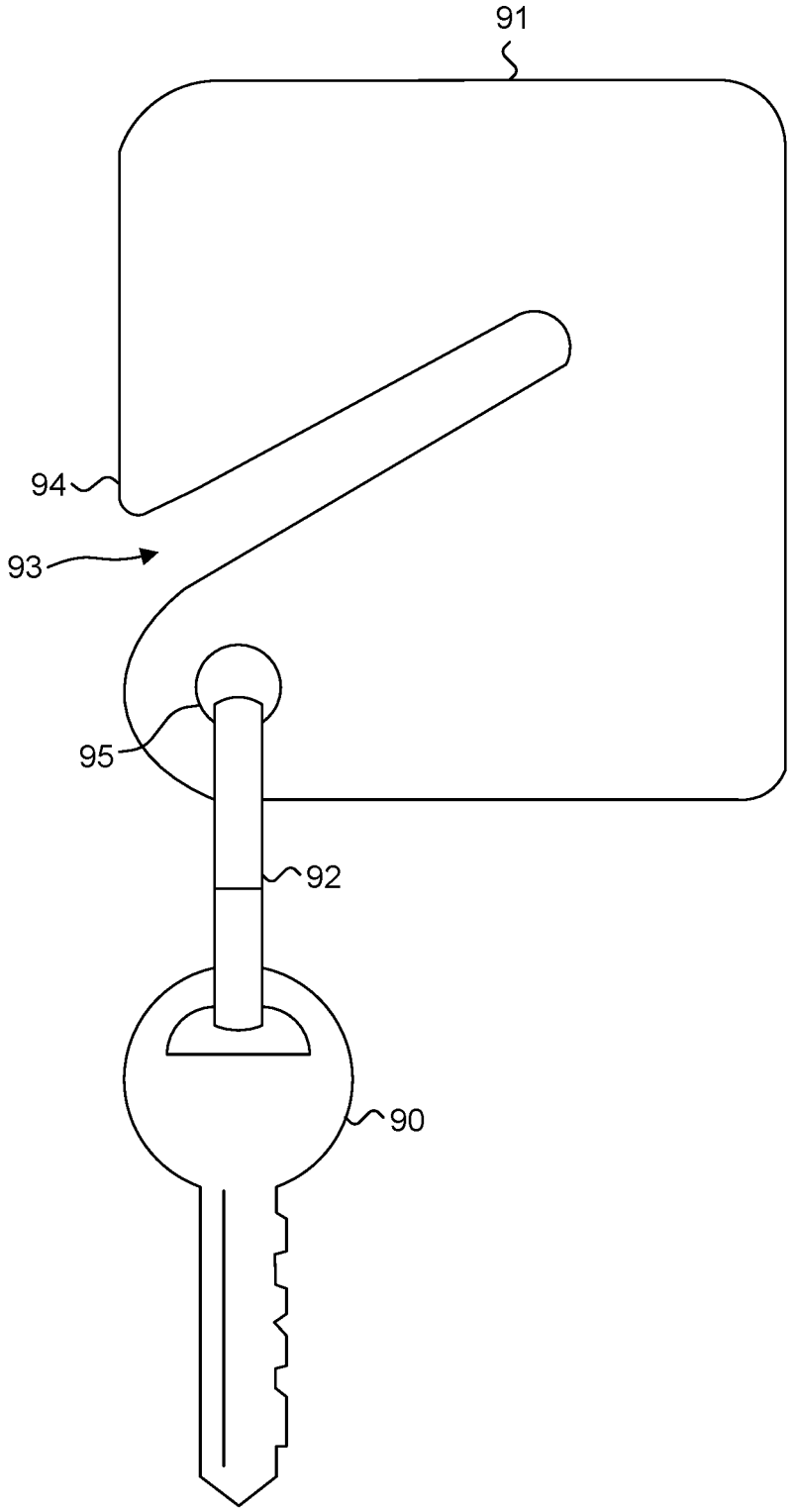
FIG. 11 is a front view of a key with a key fob.

Each key rack 81 can include multiple slots 83 for holding keys. The keys can each be placed on a key chain or fob shaped such that at least a portion of the key chain or fob fits within the key slot 83. For example, FIG. 11 is a front view of a key 90 with a key fob 91. The key fob 91 can be shaped as a square or rectangle with a cutout 93 to form a hook 94 that is inserted into the key slot to secure the key 90. The key 90 can be attached to the key fob 91 via a connector 92, such as a ring clip or oval loop, which is inserted through a hole 95 in the key fob 91. Other types and shapes of key fobs and connectors are possible. At a minimum, the key fob 91 should be constructed to connect the key to the fob and to fit at least a portion of the fob within the key slot.

Figure 12:
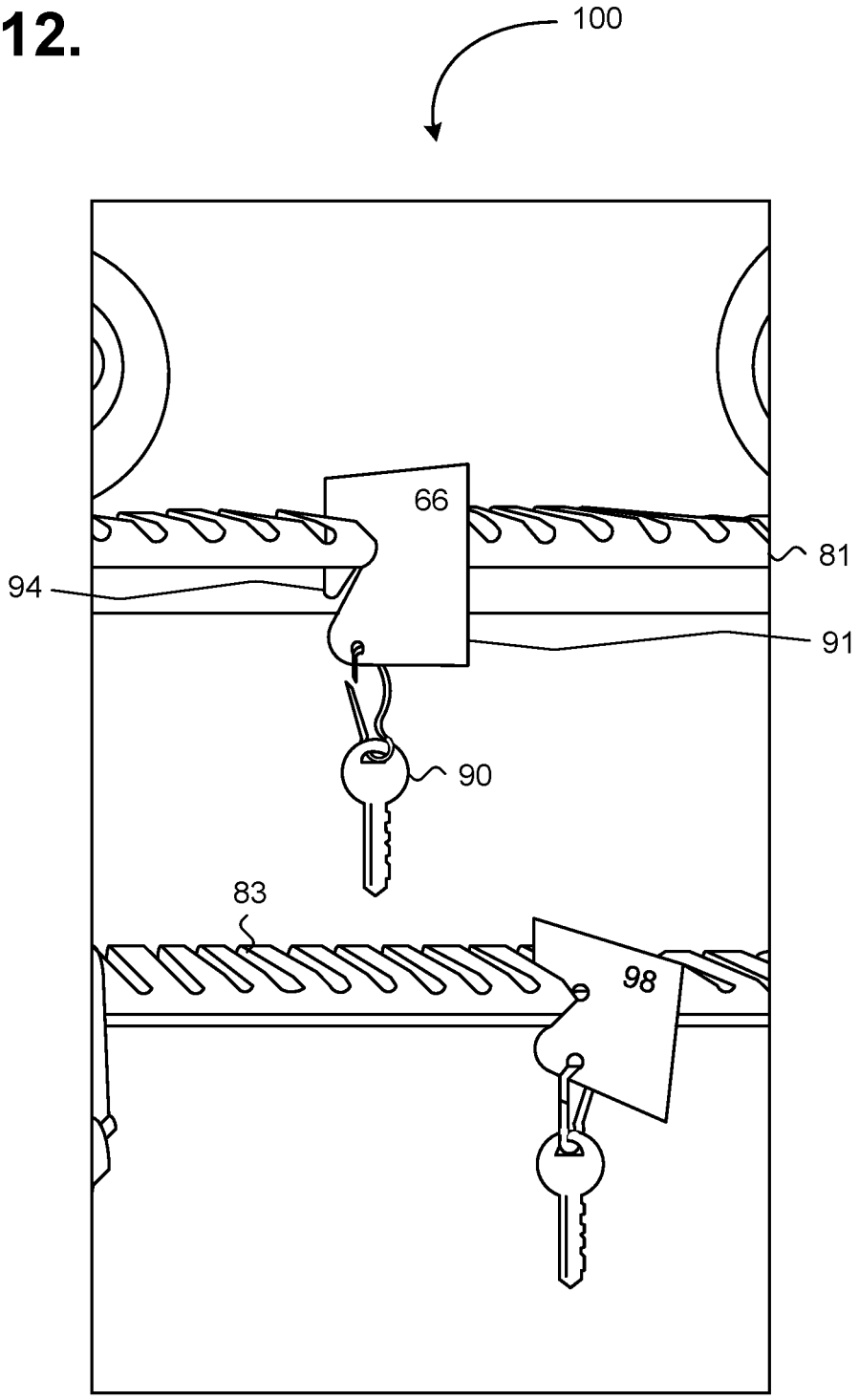
FIG. 12 is a perspective view of an interior of the key box with key racks and keys.

Once a key is attached to a key fob, the key can be hung on one of the key racks within the key box. FIG. 12 is a perspective view of an interior 100 of the key box of FIG. 9 with key racks 81 and keys 90. The key racks 81 can each include a plurality of slots 83 into which a hook 94 of the key fob 91 can be inserted and hung. Other types of racks and key fobs are possible, such as individual hooks for hanging key rings with keys or shelves. The key racks 81 can be hung along a back interior surface of the key box 70, as well as on an interior surface of the key retrieval door. IN a further embodiment, no key racks need be installed and the keys or other content to be deposited can fall to the bottom interior surface of the deposit box.

Figure 13:
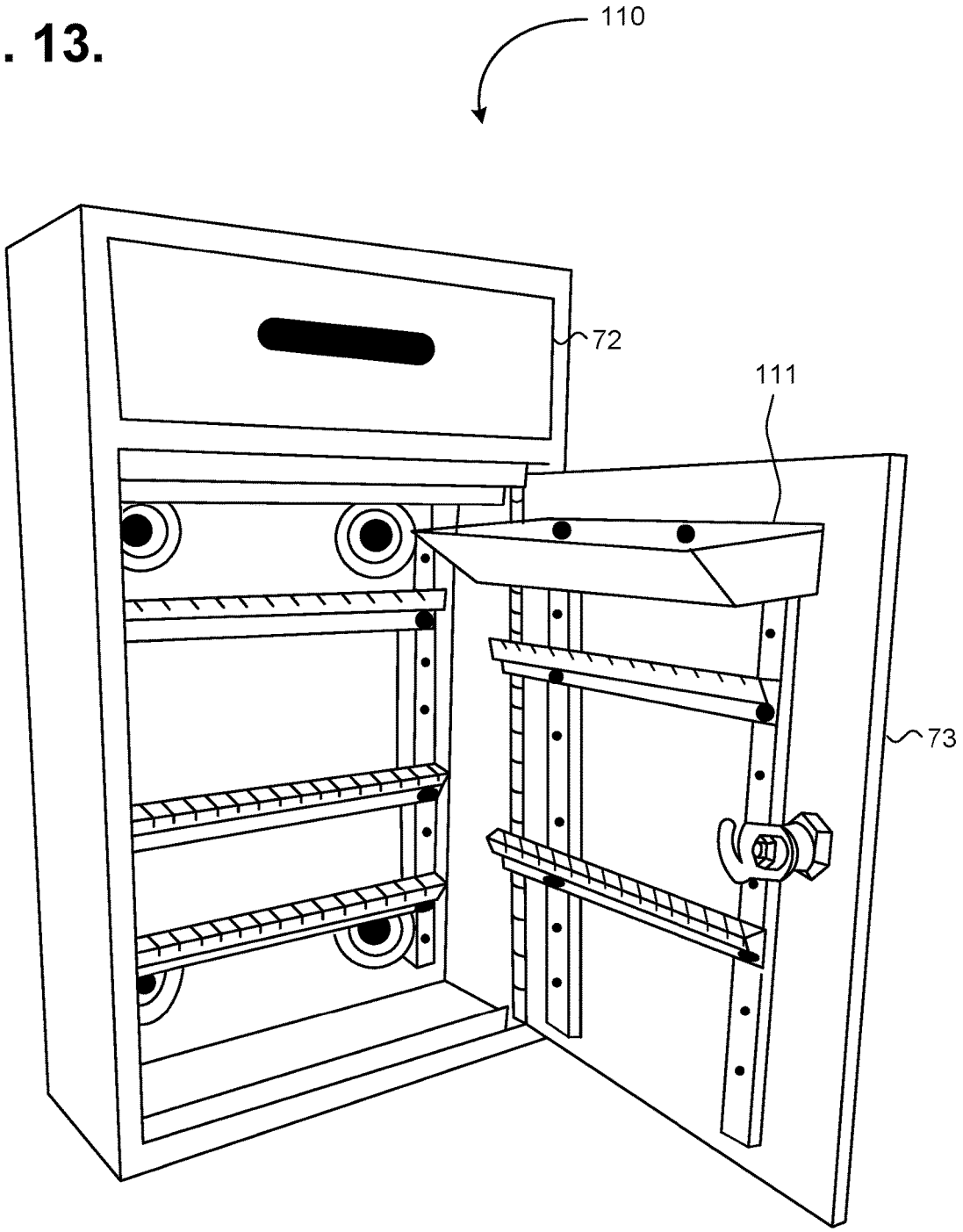
FIG. 13 is a perspective view of the key box of FIG. 9 with the key retrieval door in an open position.

An authorized user can access the deposited content, such as one or more keys, from an interior of the key box and provide the keys to a third party. Upon receipt, the keys can be returned via the key deposit door. Upon dropping a key into the key box, the returned key can be captured in a key receipt drawer for later placement on the key racks. FIG. 13 is a perspective view 110 of the key box 70 of FIG. 9 with the key retrieval door 73 in an open position. A key receipt drawer 111 can include a receptacle in which keys can be collected upon return via the key deposit door 71. A size of the key receipt drawer 11 can be dependent on the contents to be held while a size of the key receipt drawer can be dependent on a size of the key box.

Figure 14:
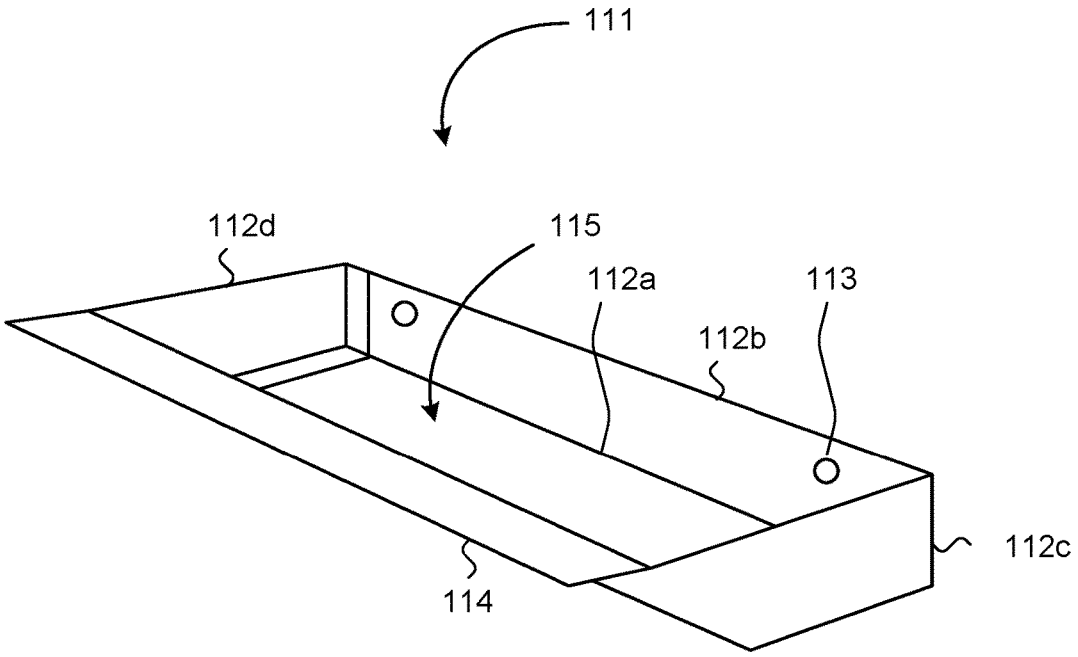
FIG. 14 is a perspective view of a key receipt drawer.

In one embodiment, the key receipt drawer can have the shape of a rectangle. FIG. 14 is a perspective view of a key receipt drawer 111. The key receipt drawer can include four sides, including front (not shown) and back (112*b*) sides, which are connected by left (112*d*) and right side (112*c*) ends, as well as a bottom surface 112*a*. In one embodiment, the front and back sides are the same length, while the side ends are the same length. In a further embodiment, all sides can be the same length. However, the key receipt drawer can have different shapes, including rectangle, square, trapezoid, triangle, funnel, or oblong, as well as other shapes. Further, the front side of the key receipt drawer can be attached at an angle to the bottom surface. The left and right sides can include a longer top edge than a bottom edge to connect with the front side that is positioned at an angle. Specifically, the angle formed between the top of the right or left side end and the front side is smaller than the angle between the bottom of the right or left side end and the front side. The four sides and the bottom surface form an empty cavity 115 in which keys can be collected.

The back side can include one or more holes 113 to connect the key receipt drawer to an interior surface of the mail retrieval door or an interior surface of the back wall of the key box via a screw, nail, or other type of connector. In a further embodiment, the key receipt drawer can be affixed to the brackets described above with respect to FIG. 10. Further, a catch panel 114 can be attached on one end to a top surface edge of the front side. The catch panel can extend from the front size of the drawer towards the interior back surface of the deposit box to prevent keys from falling to a bottom of the key box interior upon delivery via the key deposit door. In one embodiment, the catch panel 114 can be the same length as the front surface of the key receipt drawer 111, while the width of the panel can be dependent on a width of the key box and the length of the left and right sides of the key receipt drawer 111. The catch panel 114 can be optionally attached to the front side at an angle to ensure that any keys that fall onto the catch panel 114 fall in the empty cavity.

Figure 15:
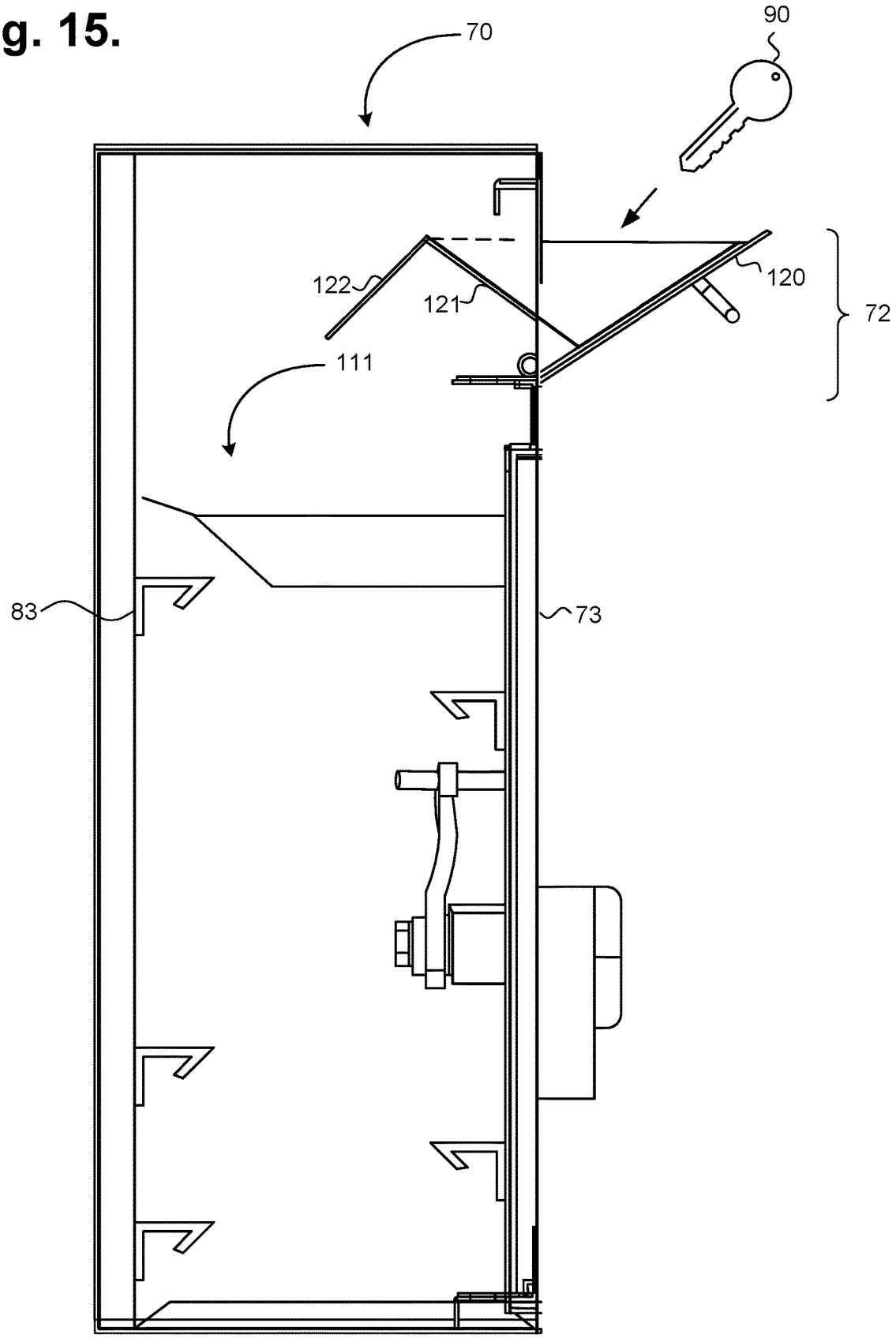
FIG. 15 is a cross-sectional view of the key box of FIG. 9 with the key deposit door in an open position.

The keys are deposited into the key box via the key deposit door 71. FIG. 15 is a cross-sectional view of the key box 70 of FIG. 9 with the key deposit door 71 in an open position. Upon opening the key deposit door 71, a key 90 can be dropped into the key box 70 and fall into the key receipt drawer 111. The key deposit door 72 includes a flat surface as a key delivery door 120 that is positioned along a front surface of the deposit box 70 when in a closed position and an inner panel 121, which is located within the interior of the housing and affixed at an angle to the flat surface 120 of the key deposit door 72 to receive and guide incoming content, such as keys, into the deposit box. More specifically, a proximal edge of the inner panel 121 can be affixed to the bottom edge of the flat surface 120 of the key deposit door 72. The angle between the inner panel 121 and flat surface 120 can vary to accommodate different size keys. In one embodiment, the angle is at least as great as a right angle. Together, the flat surface 120 of the key deposit door and inner panel 121 rotate about a horizontal axis based on the opening and closing of the key deposit door 72. A sphere of rotation is defined by movement of a distal edge of the inner panel within the housing based on the horizontal axis.

Additionally, one or more side panels (not shown) can be interfixed between the flat surface 120 of the key deposit door 72 and inner panel 121 to assist in guiding the key into the deposit box 70. The side panels can include a rod, bar, or flat surface. Other types of side panels are possible. Together, the flat surface 120, inner panel 121, and side panels form the rotatable key deposit door 72 that allows users to deliver keys and other articles into the deposit box 70. The rotatable key deposit door 72 can be rotatably affixed to the front surface of the housing via the flat panel 120, as described above, inner panel 20, or side panels.

In a further embodiment, the rotatable key deposit door 72 includes a safety arm 122 that is affixed at an angle to the inner panel 121 in a direction away from the flat surface 120 of the door 72. In one embodiment, the angle is less than 115 degrees. However, other angles are possible. At a minimum, the angle should be large enough to allow the safety arm to prevent a would-be thief from inserting his arm into the interior of the deposit box, but small enough to allow keys and other content to pass to the bottom of the deposit box interior or into the key receipt drawer 111. The length of the security arm 122 is dependent on the angle between the inner panel 121 and the security arm 122. The security arm 122 should not extend past a midline of the deposit box. The midline can be determined by bisecting a center of the deposit box parallel to the front surface, as described above with reference to FIG. 2.

Incoming keys are inserted through a slot (not shown) in the key deposit door 72, or by way of an opening formed by opening the non-lockable key deposit door 72. The security arm 122, or angled bottom member, guides keys into the interior 25 of the deposit box 70. When the key deposit door 72 is in a closed position, the security arm 122 extends in a downward fashion from the inner panel 121 towards the interior bottom side of the deposit box 70. The security arm 122 can be made from metal, steel, plastic, wood, or other material.

As the key deposit door 71 is opened, the security arm 122, or bottom member of the key delivery door effectively limits the space created when the key retrieval door is opened. In this way, the opening to the interior of the deposit box 72 is restricted by the space occupied by the security arm 122 as the key deposit door 72 moves from the open to the closed position, and at various positions in the range of motion of the key deposit door. A thief would be restricted from putting a hand into the box when the key deposit door is open or semi-open.

Once the keys are inserted into the deposit box, the keys can fall into the key deposit drawer 111. To access the keys in the key receipt drawer 111, an authorized user can open the key retrieval door 73 using a key or a combination lock. Once the key retrieval door 73 is opened, the keys in the key receipt drawer 111 can be removed and placed on one or more key racks 83.

Although the deposit box has been described above for use with mail and keys, other types of content to be deposited are possible, such as checks, money, and clothing. For example, such key box can be beneficial for rental car companies, valet services apartment managers, and suit rental companies, as well as other individuals and industries to ensure that the deposited contents remain safe and not accessible by unauthorized parties. An interior of the deposit box can be customized based on the contents to be deposited.

While the invention has been particularly shown and described as referenced to the embodiments thereof, those skilled in the art will understand that the foregoing and other changes in form and detail may be made therein without departing from the spirit and scope of the invention.

What is claimed is:

1. A wall mount deposit box, comprising:

a housing having a front side and a back side;

a content delivery door positioned along the front side of the housing;

a content retrieval door located along the front side of the housing and below the content delivery door; and a content receipt drawer affixed to one of an interior of the back side of the housing and the content retrieval door and comprising:

a side facing the front side of the housing;

a side facing the back side of the housing;

left and right sides;

a bottom surface connecting the side facing the front side of the housing, the side facing the back side of the housing, the left side, and the right side; and a catch panel affixed to a top edge of the side facing the back side of the housing and extending to the interior of the back side of the housing.

2. A wall mount deposit box according to claim 1, further comprising:

one or more key racks affixed to an interior surface of the front side of the housing or the back side of the housing.

3. A wall mount deposit box according to claim 1, wherein the catch panel is affixed to the top edge of the side facing the back side of the housing at an angle or at a level position.

4. A wall mount deposit box according to claim 1, wherein the content receipt drawer receives items provided through the content delivery door.

5. A wall mount deposit box according to claim 4, wherein the items are accessed when the content retrieval door is in an open position.

6. A wall mount deposit box according to claim 4, wherein the catch panel prevents the items from falling to a bottom surface of the housing.

7. A wall mount deposit box according to claim 1, further comprising:

an inner panel comprising a substantially flat surface and affixed on one side to a bottom of the content delivery door at an angle; and a safety arm comprising a substantially flat surface affixed at an angle on an other side of the substantially flat surface of the inner panel.

8. A wall mount deposit box according to claim 1, further comprising:

a lock provided on the content retrieval door, comprising:

a tumbler installed through the content retrieval door;

a cam rotatably coupled to one end of the tumbler and comprising a cutout on an end opposite the tumbler; and an anti-pry plate surrounding at least a portion of the cam.

9. A wall mount deposit box according to claim 1, wherein a length of the catch panel is the same as a length of the content receipt drawer.

10. A wall mount deposit box according to claim 1, wherein a width of the catch panel depends on a space between the side of the of the content receipt drawer facing the back side of the housing and the interior of the back side of the housing.

11. A method for constructing a wall mount deposit box, comprising:

obtaining a housing having a front side and a back side;

providing a content delivery door positioned along the front side of the housing;

positioning a content retrieval door located along the front side of the housing and below the content delivery door; and affixing a content receipt drawer to one of an interior of the back side of the housing and the content retrieval door, wherein the content receipt door comprises a side facing the front side of the housing, a side facing the back side of the housing, left and right sides, a bottom surface connecting the side facing the front side of the housing, the side facing the back side of the housing, the left side, and the right side, and a catch panel affixed to a top edge of the side facing the back side of the housing and extending to the interior of the back side of the housing.

12. A method for constructing a wall mount deposit box according to claim 11, further comprising:

affixing one or more key racks to an interior surface of the front side of the housing or the back side of the housing.

13. A method for constructing a wall mount deposit box according to claim 11, wherein the catch panel is affixed to the top edge of the side facing the back side of the housing at an angle or at a level position.

14. A method for constructing a wall mount deposit box according to claim 11, wherein the content receipt drawer receives items provided through the content delivery door.

15. A method for constructing a wall mount deposit box according to claim 14, wherein the items are accessed when the content retrieval door is in an open position.

16. A method for constructing a wall mount deposit box according to claim 14, wherein the catch panel prevents the items from falling to a bottom surface of the housing.

17. A method for constructing a wall mount deposit box according to claim 11, further comprising:

affixing an inner panel comprising a substantially flat surface to a bottom of the content delivery door at an angle; and affixing a safety arm comprising a substantially flat surface at an angle on an other side of the substantially flat surface of the inner panel.

18. A method for constructing a wall mount deposit box according to claim 11, further comprising:

providing a lock on the content retrieval door comprising a tumbler installed through the content retrieval door, a cam rotatably coupled to one end of the tumbler and comprising a cutout on an end opposite the tumbler, and an anti-pry plate surrounding at least a portion of the cam.

19. A method for constructing a wall mount deposit box according to claim 11, wherein a length of the catch panel is the same as a length of the content receipt drawer.

20. A method for constructing a wall mount deposit box according to claim 11, wherein a width of the catch panel depends on a space between the side of the of the content receipt drawer facing the back side of the housing and the interior of the back side of the housing.

* * * * *